United States Patent [19]

Mochly

[11] 4,156,515

[45] May 29, 1979

[54] WALL BRACKET AND ITS SUPPORT

[76] Inventor: Josef Mochly, P.O. Box 55, Shave-Zion, Israel, 25-227

[21] Appl. No.: 793,307

[22] Filed: May 3, 1977

[30] Foreign Application Priority Data

Aug. 24, 1976 [IL] Israel ..... 50351

[51] Int. Cl.[2] ..... A47G 29/02; E04G 3/08

[52] U.S. Cl. ..... 248/246; 108/108; 211/193

[58] Field of Search ..... 248/244, 245, 246, 243; 211/90, 187, 193; 108/108; 52/36

[56] References Cited

U.S. PATENT DOCUMENTS

| | | | |
|---|---|---|---|
| 1,041,264 | 10/1912 | Freud | 248/245 |
| 3,088,424 | 5/1963 | Knuth | 248/243 |
| 3,664,627 | 5/1972 | Sykes et al. | 248/246 |

FOREIGN PATENT DOCUMENTS

| | | | |
|---|---|---|---|
| 523862 | 6/1949 | Canada | 248/246 |
| 835777 | 3/1970 | Canada | 248/246 |
| 825044 | 12/1951 | Fed. Rep. of Germany | 248/243 |
| 371873 | 10/1963 | Switzerland | 248/245 |

*Primary Examiner*—J. Franklin Foss
*Attorney, Agent, or Firm*—Robert J. Koch

[57] ABSTRACT

A wall bracket for the support of a shelf, a table or a bench is fastened to a lipped box channel that is vertically positioned with its open slit towards the shelf; it is held in the channel by friction forces only and can be readily moved up and down and held at any desired height of the channel. The bracket end which is inserted into the channel through its slit has a horizontal rectangular top portion smaller than the channel inside, but wider than the slit, and is connected to the bracket body outside the channel by a neck portion of a width narrower than the slit, while the bottom portion is in the shape of a horizontal spike passing into the channel through the said slit and pressed against the channel rear by the load acting on the bracket. The bracket is inserted into, or withdrawn from the channel by turning it until its top portion is vertical and parallel with the slit and can be pushed through it.

8 Claims, 10 Drawing Figures

WALL BRACKET AND ITS SUPPORT

BACKGROUND OF THE INVENTION

Existing shelf supports commonly consist of a set of vertical channels fastened to a wall, which are perforated at regular intervals, and sets of brackets provided at their inner end with hook-like projections for engagement with the perforations in the channels. Different types and shapes of perforations and hooks exist in the various appliances available, however their common drawback is that the bracket can only be fixed at distinct height intervals, dependent on the distance between perforations. This again requires very exact alignment of the channels to obtain a common height of all perforations in adjoining channels and to permit horizontal positioning of the shelves resting on several brackets. Still another drawback is the relatively high cost of the channels due to the punching operation necessary for providing the—mainly rectangular—perforations.

In view of these disadvantages it is the object of the present invention to provide wall brackets which permit the fixation in vertical, non-perforated channels at any desired height without use of clamps or bolts. Another object is to permit vertical shifting of such bracket in upward or downward direction without withdrawing it from engagement with the channel supporting it.

A further object is to permit the manufacture of these brackets from extruded metal beams by cutting and punching operations only.

SUMMARY OF THE INVENTION

The invention, accordingly, consists of wall brackets adapted to support a shelf, a table or the like and bracket-supporting means in the shape of lipped box channels of uniform cross section, the said channels being vertically positioned with their front, lipped wall facing the said shelf or table, while connection of a bracket to a vertical channel is made by means of a connector forming an integral part of the bracket body, which comprises:

- a top portion in the shape of a horizontal plate forming the end of the bracket, symmetrical therewith and of smaller horizontal dimensions than the inside dimensions of the channel so as to permit its manual shifting inside and along the channel, the front edge of said top portion being wider than the slit formed between the channel lips and substantially parallel with the inner surface of the said lips, connection between the top portion and the bracket body outside the channel being by means of a neck portion of a horizontal width smaller than the width of the said slit, the said front edge of the top portion being adapted to be biased against the lip insides by a vertical load acting on the bracket,
- a bottom portion in spaced relationship with the top portion, symmetrical therewith in the shape of a substantially horizontal spike of a width smaller than the width of the slit in the channel front and of a length commensurate with the depth of the channel, adapted to be inserted into the channel through the said slit and to be biased against the rear wall of the channel by a vertical load acting on the bracket.

In a preferred embodiment of the invention the bracket consists of a T-beam with its horizontal flange positioned uppermost and its web aligned with the slit in the channel. The connector at the inner end of the T-beam is formed by two, preferably rectangular recesses cut out on opposite edges of the flange leaving a rectangular top portion, and by a cut-out in the vertical web at the inner end of the T-beam extending from underneath the flange to a line above the bottom edge of the web at a distance therefrom defining the upper edge of the spike-shaped portion. The bottom portion is provided with a sharpened tip at its end which extends deeper into the channel than the inner end of the top portion.

With a view to serve as a vertical guide, a shallow groove of a width somewhat larger than the width of the spike end may be provided on the inside of the channel running along the centre of the rear wall thereof.

In order to prevent inadvertent disengagement of the spike from the channel rear wall a lateral tongue may be provided projecting sideways to one side of the spike-shaped portion and adapted to engage with the inside of one of the lips of the box channel, while the spike end is positioned within the said central groove.

DRAWINGS

In the accompanying drawings which illustrate, by way of example, various embodiments of the invention, FIG. 1 is a perspective view of a bracket positioned within a lipped box channel, the sides of which are partly cut away in order to show the connector clearly, FIG. 2 is a vertical section through the channel and a side view of the bracket as illustrated in FIG. 1, FIG. 3 is a vertical section through a modified box channel, and a side view of a bracket positioned therein, FIG. 4 is a section along A—A of FIG. 3, FIG. 5 is a cross section through another embodiment of a lipped channel, FIG. 6 is a cross section through a standard channel having a rubber strip attached to its inside, as well as a plan view of the bracket, FIG. 7 is a vertical section through a box channel of trapezoidal cross section and a side view of a bracket connector adapted to engage with the channel, FIG. 8 is a section along B—B of FIG. 7, FIG. 9 is a section along C—C of FIG. 7, and FIG. 10 is a section along D—D of FIG. 8.

DESCRIPTION OF PREFERRED EMBODIMENTS OF THE INVENTION

Figure 1:
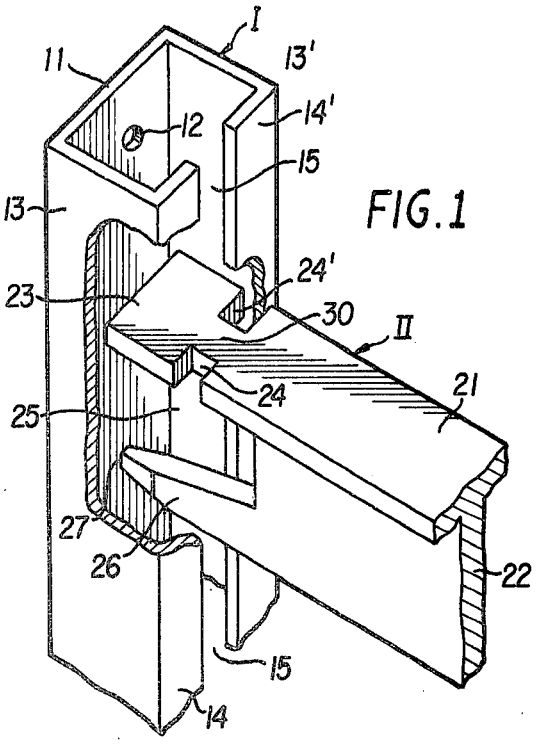
Figure 2:
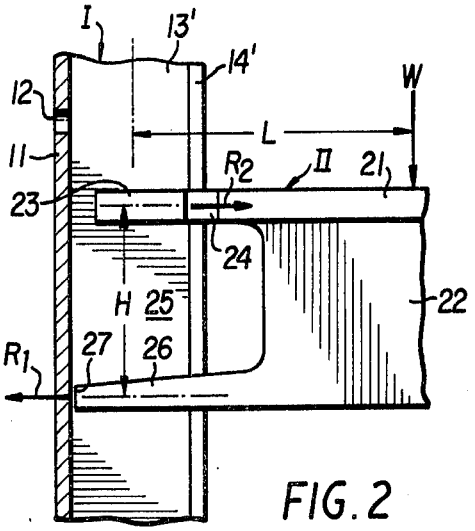

FIGS. 1 and 2 of the drawings illustrate the connector of a wall bracket II, inserted into a vertical lipped box channel I. The box channel comprises a real wall 11, provided with holes 12 for attachment to a wall or the like, two side walls 13 and 13' and two front wall lips 14 and 14' respectively, which form a slit 15 therebetween.

The bracket II of a T-section comprises a horizontal flange 21 and a vertical web 22. The connector top portion in the shape of a rectangular plate 23 is formed out of the flange 21 by two rectanguler recesses 24 and 24' cut into this flange near the inner end of the bracket leaving a neck portion 30, and by a cut-out 25 in the web 23 adjoining the inner end and extending from underneath the flange to a line defining the upper edge of the spike-shaped bottom portion 26. The latter extends deeper into the box channel than the top portion, and its inner end is sharpened to an edge 27 bearing against the rear wall of the box channel I. The connection between the bracket and the box channel and the fixation of the bracket by friction forces is depicted in FIG. 2. Herein a vertical load W applied to a point on the bracket at a distance L from the centre of the channel, creates a moment $M=W \cdot L$, which is counteracted by horizontal reaction forces $R_1$ and $R_2$ pressing the connector against the channel walls in opposite directions. The spike end 27 is pressed against the rear wall 21 by a force $R_1$, while the inner edges of the recesses 24 and 24' press against the inside of the lips 14 and 14' with an equal force $R_2$. These forces are directly proportional to the moment M caused by the load W, in inverted ratio to their vertical distance H, as expressed by the formula $$R_{(1.2)}=M/H=W \cdot L/H.$$

The forces R wedge the bracket connector between the front and rear wall of the channel and hold it at the chosen height by friction only. Increased load will increase the forces R and, accordingly, the resistance to the sliding down of the bracket. It is pointed out that a slight deformation of the channel walls takes place, especially caused by the spike end 27 slightly indenting the rear wall, increasingly preventing any tendency to slide downward. Shifting of the bracket is performed by somewhat lifting the outer bracket end which frees the connector from contact with the channel walls, and then raising or lowering the bracket into a new position.

Figure 3:
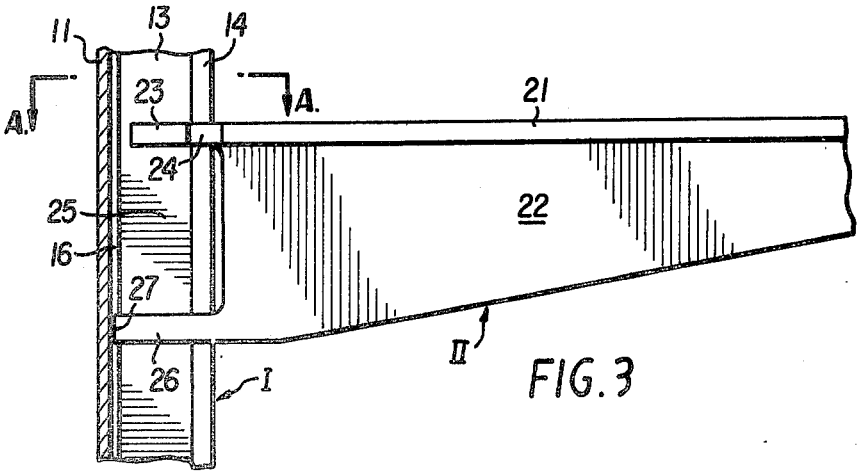
Figure 4:
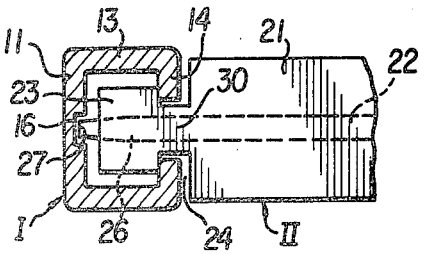
Figure 5:
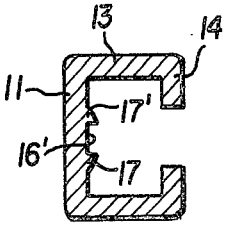
Figure 6:
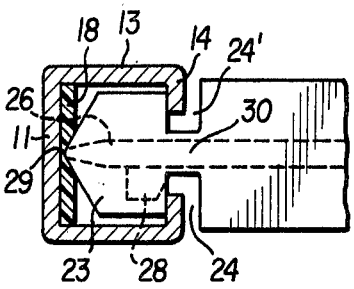

With a view to maintaining the bracket within the centre of the channel it is advantageous to provide a guide for the spike end:

such guide is shown in FIGS. 3, 4 and 5, wherein the inside of the channel rear wall is provided with a longitudinal groove 16, 16', either in the shape of a recess (16 in FIGS. 3 and 4), or by means of two raised ridges 17, 17' on both sides of a groove 16' as illustrated in FIG. 6.

Figure 7:
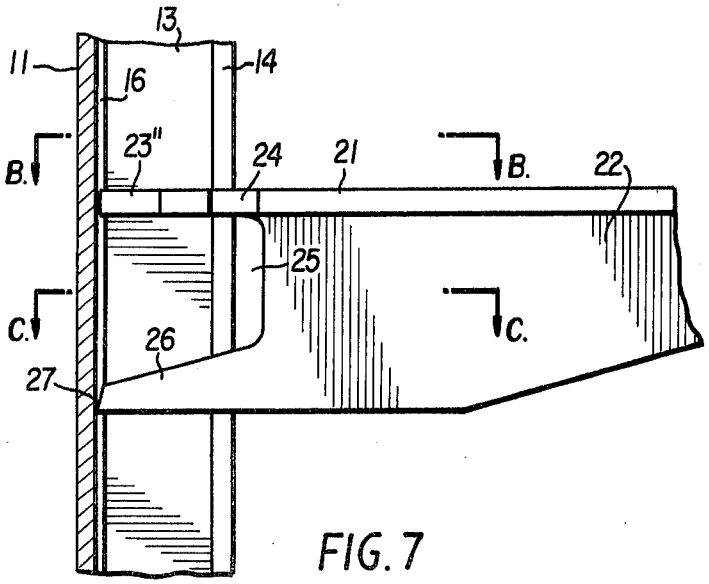

A different embodiment of the bracket is illustrated in FIG. 6, wherein the material forming the bracket body is in the shape of an I-beam, comprising a top flange 21, a bottom flange 21' and a web 22. The top portion 23' of the connector and the spike are similar to those in the embodiment illustrated in FIGS. 1 and 2, and are formed by cutting out the portions 24, 24' and 25. In addition, the bottom flange 21' is cut out on both sides adjoining the spike 26 to permit its insertion into the channel through the slit 15, except for a short lateral tongue 28 left over on one side of the said spike. The combined width of the tongue and the bottom portion is less than the width of the channel slit (15) so as to permit its passage therethrough. The object of the tongue is to prevent inadvertent lifting of the bracket, by that it bears on the inside of one of the lips 14 after the spike has been centred. This position is shown in FIG. 7.

Another feature is the provision of a projecting edge 29 at the inner end of the top portion 23'. This edge serves to additionally secure the bracket in its position by contact with a strip of a resilient material 18, such as rubber, laid along and attached to the rear wall 11 of the channel. FIG. 7 shows a slight indention made in the resilient material by this edge; incidentally, a similar indention is made by the spike, whereby the friction holding the bracket in position is considerably increased.

Figure 8:
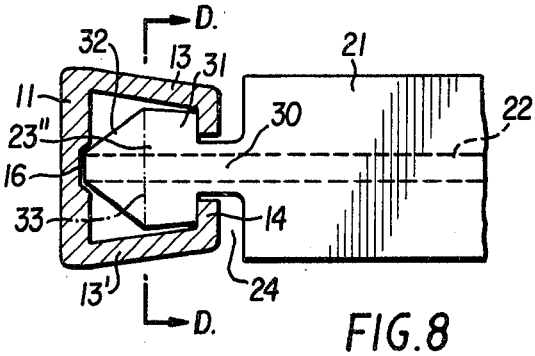
Figure 9:
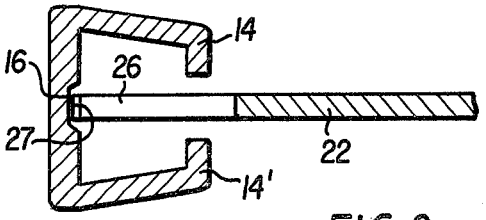
Figure 10:
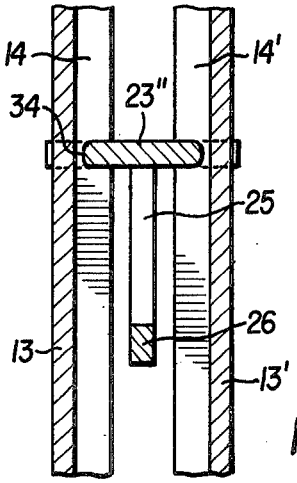

The embodiment illustrated in FIGS. 8 to 10 is characterised by the trapezoidal cross-section of the box channel, which comprises a wider rear wall 11, a somewhat narrower, lipped front wall 14 and converging side walls 13, 13'. The inside of the rear wall is provided with a recessed groove 16 similar to that shown in FIG. 5.

The bracket, of T-section, is similar in most respects to that illustrated in FIGS. 1 and 2, the main difference being in the shape of the top portion plate 23''. This has the configuration of a polygon composed of a trapezoidal front portion 31 and a triangular rear portion 32 which meet along a common base line 33. The total depth of the plate 23'' is commensurate with the depth of the channel leaving a small clearance only. The lateral edges 34 of the plate 23'' are rounded for ready insertion of the connector into the channel, as will be explained further on. The spiked bottom portion is substantially identical with that illustrated in FIGS. 1 and 2. The bracket connector which, of course, may be placed into a channel through its open end, may also be inserted through the slit in its front wall, by turning the bracket about a right angle, so as to place the top portion plate into vertical position, and pushing this plate through the slit. While returning the bracket into its normal position it is necessary to lift its outer end so as to permit the passage of the spike until it faces the said slit. Then the bracket end is lowered again and the spike is inserted through the slit until it presses against the channel rear wall.

Returning now to FIG. 4, herein the web 22 is shown to be cut off at a slope, not only for esthetic reasons, but for saving of weight, since from a mechanical point of view the large cross section is required at the inner bracket only. It is obvious that, instead of using extruded material to be punched and cut into the desired shape, the bracket may be manufactured by other methods, such as die-casting, injection-molding, pressing or the like.

Both the bracket and the channel may be fabricated from any material strong enough to support the forces acting on them: a preferred material is aluminium in extruded shape, but steel may be employed likewise, if its surface is sufficiently corrosion-proof. The shape of the bracket itself is not limited to the profiles described in the foregoing, but it may be modified to suit various purposes; and it is proposed to make the bracket body from pipes or bars of circular or rectangular cross section. However, it has been experienced that T-sections are the most suitable because of ease of manufacture of the connector portion by simple punching operations.

With reference to FIGS. 3 and 7 showing a tongue 28 projecting sideward from the spike 26 as part of an I-beam, it is proposed to provide a similar tongue on a bracket fabricated from a T-section, by inserting a pin of similar proportions to the tongue into one flank of the bottom portion of the web.

Other modifications and alterations to the bracket and the box channel support may be carried out by a person skilled in the art, however without deviating from the spirit of the invention and the scope of the following claims.

I claim:

1. In an adjustable support for a shelf or the like comprising the combination of a vertical, lipped box channel and a bracket frictionally held in the inner space of said channel, wherein said channel is of uniform cross section and comprises a rear wall, two side walls and two frontal lips defining an open slit of uniform width between the inner edges of said lips, the improvement comprising:

said bracket, having a rear end and a front end, being formed of a T-section with its flange uppermost in substantially horizontal position and with its web in substantially vertical position, the thickness of said flange and of said web being less than the width of said open slit in said box channel, said flange being divided into a shelf-supporting section at its front end positioned outside of said channel, and a connector section at its front end positioned inside said channel, said sections being joined by a neck portion positioned in said slit of said channel of smaller height and width than said slit, said neck portion being formed by two recesses cut into opposite sides of said flange at a distance from the rear end, said neck portion being further defined by a cut-out in said web extending forwardly from the rear end of said web to a point outwardly of said channel lips, the portion of said flange above said cut-out defining a connector section, the lower edge portion of said web below said cut-out being shaped to form a substantially horizontal spike adapted to be forced, by a load on the shelf-supporting section, against the inner surface of said channels rear wall, said spike being also provided with at least one stop element projecting laterally from one side of said spike, being rigid therewith and positioned within the inner space of said channel adjacent the inner face of one of the lips, the combined width of said web and said stop element being less than the width of said slit between said channel lips, so as to permit its passage therethrough.

2. A wall bracket connector as defined in claim 1, wherein said connector section is in the shape of a substantially rectangular horizontal plate of a width smaller than the inside width of the channel and of a depth smaller than the inside depth of the channel.

3. A wall bracket connector as defined in claim 1, wherein the top portion is in the shape of a horizontal plate of a depth somewhat smaller than the inside depth of the channel, the rear end of the plate being in the form of a triangle with its apex facing the centre of the channel.

4. A wall bracket connector as defined in claim 1, wherein said spike is provided with a sharpened tip at its inner end which extends deeper into the channel than the inner end of the connector section.

5. A wall bracket connector as defined in claim 1 wherein said rear wall of said channel is provided with an inwardly facing longitudinal central groove receiving the inner end of said spike.

6. A wall bracket connector as defined in claim 5 wherein said groove is defined by parallel ridges projecting inwardly from said rear wall.

7. A wall bracket connector as defined in claim 1 wherein said box channel is of trapezoidal symmetrical sectional shape, the width of the rear wall being greater than the width of the front wall.

8. A wall bracket connector as defined in claim 7 wherein said connector section is in the shape of a polygonal plate having a trapezoidal front portion and a triangular rear portion, both having a common base line.

* * * * *